US012320562B1

(12) United States Patent
Searcy et al.

(10) Patent No.: US 12,320,562 B1
(45) Date of Patent: Jun. 3, 2025

(54) AIR CONDITIONING AND HEAT PUMP SYSTEM WITH BULBLESS THERMOSTATIC EXPANSION VALVE

(71) Applicant: Parker-Hannifin Corporation, Cleveland, OH (US)

(72) Inventors: Dustin B. Searcy, Washington, MO (US); Eric R. Coyle, Chesterfield, MO (US)

(73) Assignee: Parker-Hannifin Corporation, Cleveland, OH (US)

( * ) Notice: Subject to any disclaimer, the term of this patent is extended or adjusted under 35 U.S.C. 154(b) by 197 days.

(21) Appl. No.: 18/184,871

(22) Filed: Mar. 16, 2023

Related U.S. Application Data

(60) Provisional application No. 63/378,134, filed on Oct. 3, 2022, provisional application No. 63/341,467, filed on May 13, 2022.

(51) Int. Cl.
*F25B 41/335* (2021.01)

(52) U.S. Cl.
CPC ..... *F25B 41/335* (2021.01)

(58) Field of Classification Search
CPC ..... F25B 41/335; F25B 13/00
See application file for complete search history.

(56) References Cited

U.S. PATENT DOCUMENTS

| | | | |
|---|---|---|---|
| 9,557,085 | B2 | 1/2017 | Hamada et al. |
| 9,863,680 | B2 | 1/2018 | Nakajima et al. |
| 2014/0352338 | A1 | 12/2014 | Mizobata et al. |

FOREIGN PATENT DOCUMENTS

| | | | | |
|---|---|---|---|---|
| CN | 107560105 | A | 1/2018 | |
| EP | 1052464 | A2 * | 11/2000 | ..... F25B 41/062 |
| EP | 2330359 | A1 | 6/2011 | |

(Continued)

OTHER PUBLICATIONS

Jiankai Dong et al., "Improving reverse cycle defrosting performance of air source heat pumps using thermal storage-based refrigerant sub-cooling energy," Building Services Engineering Research and Technology, vol. 33, Issue 2, pp. 223-236, May 16, 2012. URL: https://www.researchgate.net/publication/258127141_Improving_reverse_cycle_defrosting_performance_of_air_source_heat_pumps_using_thermal storage-based_refrigerant_sub-cooling_energy.

*Primary Examiner* — Kun Kai Ma
(74) *Attorney, Agent, or Firm* — Renner, Otto, Boisselle & Sklar, LLP

(57) ABSTRACT

A split reversible heat pump/air conditioning system employs a single, bulbless thermostatic expansion valve (TEV) that spans both the common liquid line and the suction line. The system includes a compressor that supplies a refrigerant flow along a refrigerant pathway; an indoor heat exchanger; an outdoor heat exchanger; a reversing valve located along the refrigerant pathway between the outdoor heat exchanger and the compressor, and between the indoor heat exchanger and the compressor; and a bulbless TEV comprising a valve portion located along a common liquid line of the refrigerant pathway between the indoor heat exchanger and the outdoor heat exchanger that throttles the refrigerant flow as between the indoor heat exchanger and the outdoor heat exchanger, and a sensor portion for sensing pressure and temperature located along a suction line of the refrigerant pathway between the compressor and the reversing valve.

13 Claims, 4 Drawing Sheets

(56) References Cited

FOREIGN PATENT DOCUMENTS

| | | | | | |
|---|---|---|---|---|---|
| JP | 2009014292 | A | * | 1/2009 | |
| KR | 100556116 | B1 | * | 3/2006 | |
| WO | WO-2016080343 | A1 | * | 5/2016 | ..... B60H 1/00007 |
| WO | WO-2022235632 | A1 | * | 11/2022 | ..... F25B 41/325 |

* cited by examiner

AIR CONDITIONING AND HEAT PUMP SYSTEM WITH BULBLESS THERMOSTATIC EXPANSION VALVE

This application claims the benefit of U.S. Provisional Application No. 63/378,134, filed Oct. 3, 2022 and U.S. Provisional Application No. 63/341,467, filed May 13, 2022, each of which is hereby incorporated herein by reference in its entirety.

FIELD OF INVENTION

The present application relates to a split reversible heat pump/air conditioning system that is operable to perform both heating and cooling, and to a manner of incorporating a bulbless thermostatic expansion valve into a split reversible heat pump/air conditioning system.

BACKGROUND OF THE INVENTION

Split reversible heat pump/air conditioning systems are operable to perform both heating and cooling. Conventional reversible split systems place separate thermostatic expansion valves on the indoor and outdoor heat exchanger systems to control superheat. There typically will be a length of piping (typically 20'-40' of piping) between the thermostatic expansion valves.

More specifically, a thermostatic expansion valve (TEV) is a component of a vapor compression system, such as a split reversible heat pump/air conditioning systems, that is used for refrigerant expansion and cooling. The flow control of refrigerant by a TEV conventionally is achieved by sensing the temperature of the suction line via a bulb that is mechanically coupled to the suction line. The actuator portion of the TEV (away from the pin and port) is referred to as the power element which is fluidly connected to the sensing bulb using a metallic capillary tube. The sensing bulb is charged with refrigerant, which expands or contracts with changes in temperature and pressure. A change in temperature and pressure is communicated to the power element via the capillary tube. The changes in pressure cause a welded diaphragm to move within the power element, which in turn exerts force on the pin to move closer or away from a port, thus opening or closing the valve. The control achieved using a pressure-temperature (P-T) relationship is referred to as superheat control, which is an adjustable feature within a TEV by a spring and an adjustable mechanism provided at a lower section of the valve.

As an alternative to the conventional TEV that senses using a bulb, bulbless TEVs have been developed for use in a vapor compression system, with bulbless TEVs being particularly suitable for residential air conditioner systems due to their more compact size and ease of installation. In general, a bulbless TEV does not utilize an external thermostatic sensing bulb with a corresponding external capillary tube to sense temperature in the system at the refrigerant suction line, and thus all of the sensing fluid may be contained in a closed thermodynamic system in the sensor enclosure. The elimination of the bulb eliminates issues associated with poor attachment of the bulb on the suction line, which typically is accomplished with a metallic clamp often resulting in discontinuous contact with the suction line and results in the valve failing to control superheat as intended. The corresponding elimination of the capillary tube also eliminates issues with capillary tube breakage or charge migration in the capillary tube, such as due to condensation in the capillary tube. In addition, a bulbless configuration provides a relatively short path between the suction line and the power element, and thus issues such as clogging, unwanted cooling, and other deficiencies due to longer pathway are minimized.

As referenced above, conventional reversible split systems that perform both heating and cooling place separate TEVs on the indoor and outdoor heat exchanger systems to control superheat, and there typically will be a length of piping (typically 20'-40') between the TEVs. In particular, conventional components of reversible heat pump/air conditioning systems include two thermostatic expansion valves, each with an internal check valve, that are used in the reversible split system to control the superheat in both heating and cooling modes. In cooling mode, the indoor valve controls superheat and the outdoor valve is bypassed through an internal check valve. In heating mode, the outdoor valve controls superheat and the indoor valve is bypassed through an internal check valve.

SUMMARY OF INVENTION

The split reversible heat pump/air conditioning system of the current application is a package system that employs only one bi-flow thermostatic expansion valve (TEV) with no check valves. Such a system is therefore more compact, as the extra piping between the TEVs of the conventional reversible split system is eliminated. In addition, by the use of a single bulbless TEV eliminating check valves for bypass, the configuration lowers cost and simplifies the system as compared to conventional configurations. Accordingly, fewer components are required for the overall system. The location of the TEV in the package system also increases the amount of liquid flowing through the heat exchangers, which improves distribution and may increase the capacity of the system. In addition, by sensing temperature and pressure immediately before the compressor, the TEV in the package system can be set to a lower superheat setting while protecting the compressor from liquid refrigerant. This will result in less heat that needs to be rejected and therefore results in higher system efficiency.

The valve portion of a bulbless TEV is placed on the common liquid line of the reversible split system. The valve portion particularly is placed on the common liquid line between the indoor heat exchanger and the outdoor heat exchanger and throttles the refrigerant flow as between the indoor heat exchanger and the outdoor heat exchanger. To control superheat, the bulbless TEV senses temperature and pressure on the suction line that provides the refrigerant flow into the compressor. A sensor portion of the bulbless TEV is therefore placed between a reversing valve and the compressor on the suction line. In this location, the sensor portion will sense the superheat before refrigerant enters the suction of the compressor. All components of the system except for the indoor heat exchanger (i.e., the outdoor heat exchanger, the reversing valve, the compressor, and the thermostatic expansion valve) may be packaged in a common outdoor unit of the system.

An aspect of the invention, therefore, is a split reversible heat pump/air conditioning system having an enhanced configuration employing a single, bulbless TEV that spans both the common liquid line and the suction line. In exemplary embodiments, the system includes a compressor that supplies a refrigerant flow along a refrigerant pathway; an indoor heat exchanger; an outdoor heat exchanger; a reversing valve located along the refrigerant pathway between the outdoor heat exchanger and the compressor, and between the indoor heat exchanger and the compressor; and a thermostatic expansion valve comprising a valve portion located along a common liquid line of the refrigerant pathway between the indoor heat exchanger and the outdoor heat exchanger that throttles the refrigerant flow as between the indoor heat exchanger and the outdoor heat exchanger, and a sensor portion for sensing pressure and temperature located along a suction line of the refrigerant pathway between the compressor and the reversing valve.

In an exemplary embodiment of the split reversible heat pump/air conditioning system, the sensor portion of the thermostatic expansion valve is a bulbless pressure and temperature sensor.

In an exemplary embodiment of the split reversible heat pump/air conditioning system, the sensor portion includes a diaphragm, and the diaphragm is positioned with the suction line running below the diaphragm and a refrigerant charge maintained above the diaphragm.

In an exemplary embodiment of the split reversible heat pump/air conditioning system, during an air conditioning mode the valve portion of the thermostatic expansion valve throttles the refrigerant flow into the indoor heat exchanger based on a temperature and pressure sensed by the sensor portion on the suction line, and during a heat pump mode the refrigerant flow is reversed by the reversing valve relative to the air conditioning mode and the valve portion of the thermostatic expansion valve throttles refrigerant flow into the outdoor heat exchanger based on the temperature and pressure sensed by the sensor portion on the suction line.

In an exemplary embodiment of the split reversible heat pump/air conditioning system, the outdoor heat exchanger, the reversing valve, the compressor, and the thermostatic expansion valve are packaged in a common outdoor unit of the split reversible heat pump/air conditioning system.

In an exemplary embodiment of the split reversible heat pump/air conditioning system, the thermostatic expansion valve includes a valve body having a first port and a second port; a valve member movable relative to the valve body for controlling flow of an operating fluid through the valve body; a power element including a housing and a diaphragm positioned within the housing, the diaphragm having a first side operatively coupled to the valve member and a second side opposite the first side; and a thermostatic sensor including a sensor enclosure operatively mounted to the power element, wherein a portion of the sensor enclosure together with a portion of the second side of the diaphragm form a sensing chamber in which a sensing fluid is contained; wherein changes in the temperature of the sensing fluid results in changes in pressure applied to the second side of the diaphragm, thereby causing movement of the diaphragm which provides movement of the valve member operatively coupled to the first side of the diaphragm.

In an exemplary embodiment of the split reversible heat pump/air conditioning system, the first port and the second port are part of the common liquid line between the indoor heat exchanger and the outdoor heat exchanger.

In an exemplary embodiment of the split reversible heat pump/air conditioning system, the thermostatic expansion valve further includes a suction line inlet and a suction line outlet that are part of the suction line between the reversing valve and the compressor.

In an exemplary embodiment of the split reversible heat pump/air conditioning system, the sensor enclosure of the thermostatic expansion valve is adapted to be operatively mounted to the suction line.

In an exemplary embodiment of the split reversible heat pump/air conditioning system, a region at the first side of the diaphragm is configured to be in communication with an operating fluid of the system, such that heat is transferable across the diaphragm between the sensing chamber and the region at the first side, whereby changes in the temperature of the sensing fluid results in changes in pressure applied to the second side of the diaphragm, and pressure from the operating fluid is applied to the first side, and wherein the diaphragm and thereby the valve member are configured to move in response to the pressure differential on the first and second sides of the diaphragm.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto. Features that are described and/or illustrated with respect to one embodiment may be used in the same way or in a similar way in one or more other embodiments and/or in combination with or instead of the features of the other embodiments.

DESCRIPTION

Figure 1:
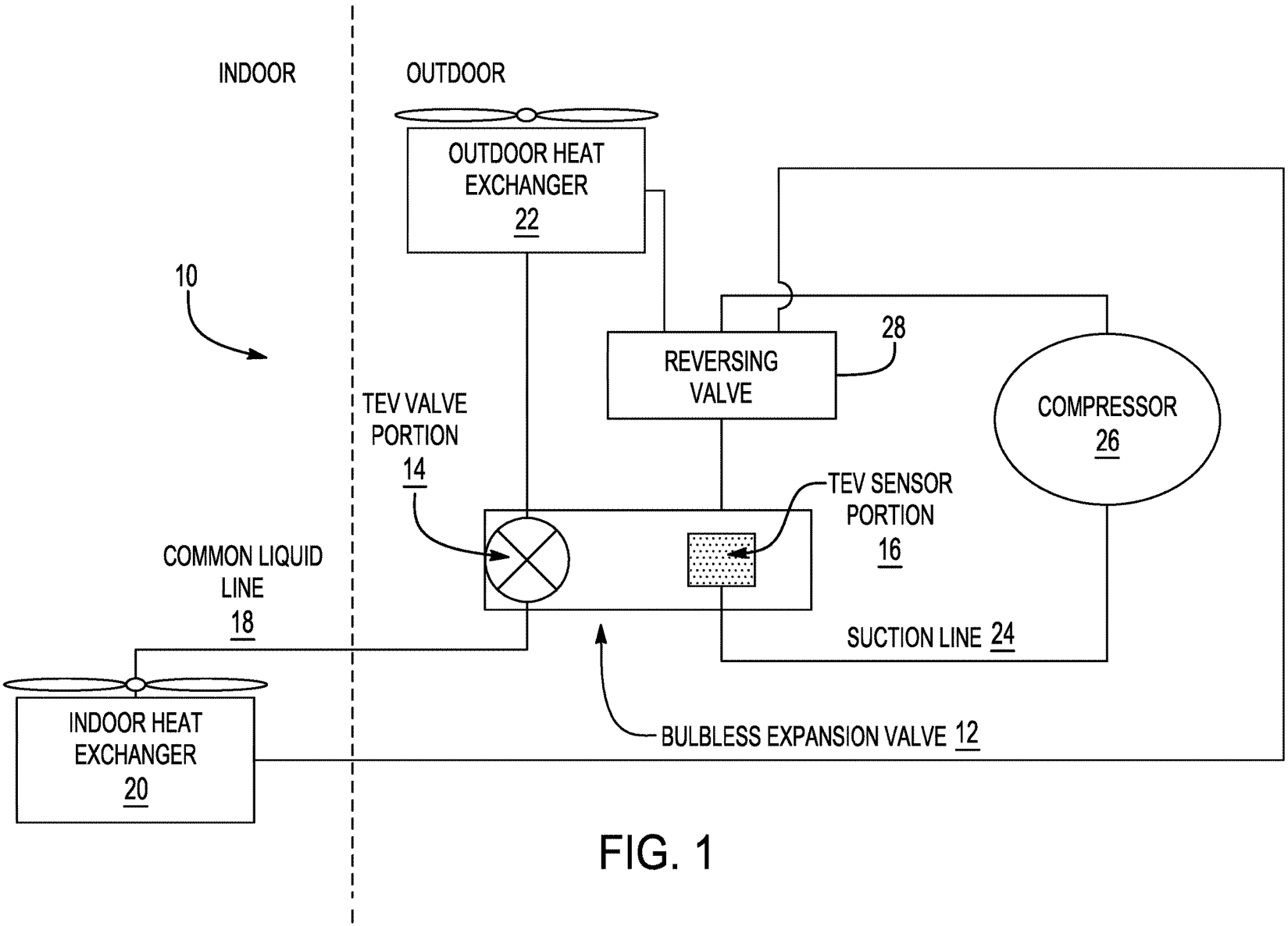
FIG. 1 is a block diagram drawing depicting a split reversible heat pump/air conditioning system employing a single TEV in accordance with embodiments of the present application.

Embodiments of the present application will now be described with reference to the drawings, wherein like reference numerals are used to refer to like elements throughout. It will be understood that the figures are not necessarily to scale.

Figure 2:
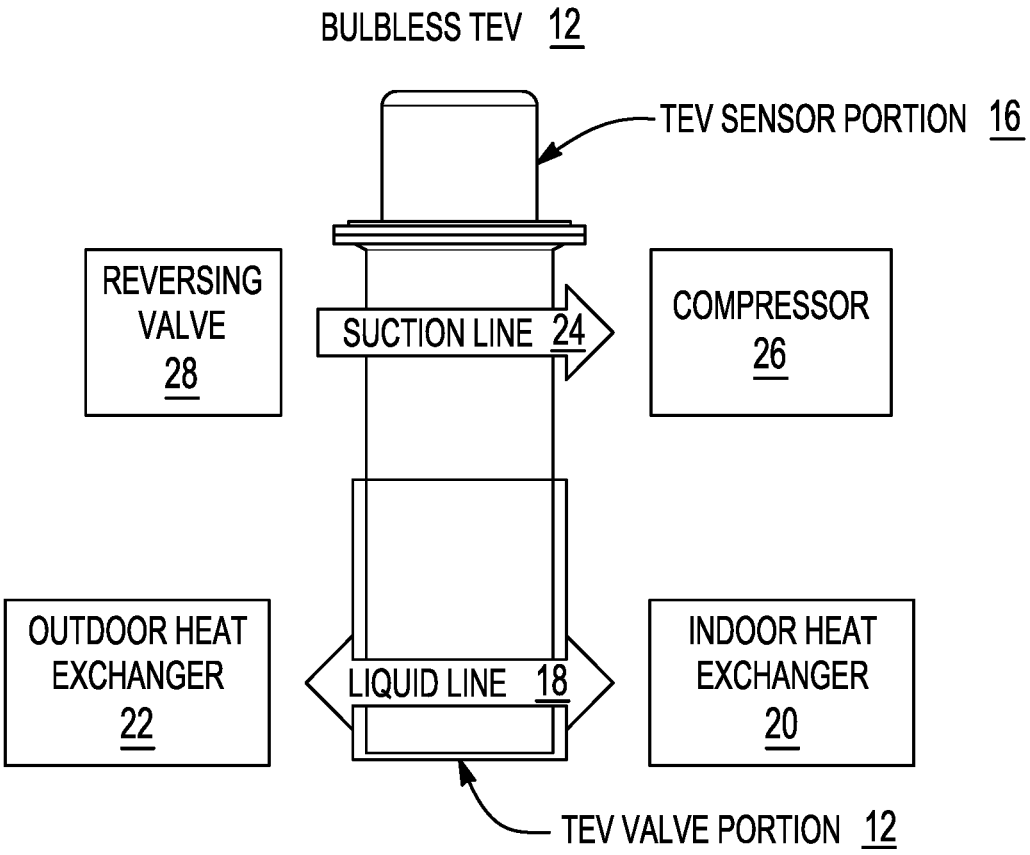
FIG. 2 is a drawing depicting a generalized schematic depiction of a bulbless TEV used in the system of FIG. 1 and illustrating the refrigerant flow paths through the TEV.

FIG. 1 is a drawing depicting a split reversible heat pump/air conditioning system 10 employing a single bulbless TEV 12 in accordance with embodiments of the present application. FIG. 2 is a drawing depicting a generalized schematic showing the bulbless TEV 12 used in the system of FIG. 1 and illustrating the refrigerant flow paths through the bulbless TEV. The bulbless TEV 12 includes a TEV valve portion 14 and a TEV sensor portion 16. The valve portion 14 of the bulbless TEV 12 is placed on a common liquid line 18 of the reversible split system 10. The valve portion 14 particularly is placed on the common liquid line 18 between an indoor heat exchanger 20 and an outdoor heat exchanger 22, and the valve portion 14 throttles a refrigerant flow as between the indoor heat exchanger 20 and the outdoor heat exchanger 22. To control superheat, the bulbless TEV 12 senses temperature and pressure on a suction line 24 through which the refrigerant is suctioned into a compressor 26. The TEV sensor portion 16 of the bulbless TEV 12 is therefore placed between a reversing valve 28 and the compressor 26 on the suction line 24. In this location, the sensor portion 16 will sense the superheat before refrigerant enters the suction of the compressor 26. All components of the system except for the indoor heat exchanger 20 (i.e., the outdoor heat exchanger 22, the reversing valve 28, the compressor 26, and the bulbless thermostatic expansion valve 12) may be packaged in a common outdoor unit of the split reversible heat pump/air conditioning system 10.

During an air conditioning mode, the valve portion 14 of the bulbless TEV 12 throttles refrigerant flow into the indoor heat exchanger 20 based on the temperature and pressure sensed by the bulbless TEV sensor portion 16 on the suction line 24. During a heat pump mode, the flow is reversed, and the valve portion 14 of the same bulbless TEV 12 throttles refrigerant flow into the outdoor heat exchanger 22 based on the temperature and pressure sensed by the bulbless TEV sensor portion 16 on the suction line 24. As further detailed below, the sensor portion 16 senses temperature and pressure by providing a diaphragm positioned with the suction line running below the diaphragm, and a refrigerant charge maintained above the diaphragm. Temperature and pressure are sensed by the effect on the diaphragm caused by the suction line flow relative to the refrigerant charge. The air conditioning mode versus the heat pump mode is switched by the reversing valve 28, which ensures that in both modes the refrigerant enters the compressor 26 via the suction line 24.

In this manner, the split reversible heat pump/air conditioning system 10 of the current application is a package system that employs only one bi-flow, bulbless thermostatic expansion valve with no additional check valves. Such a system is therefore more compact as compared to conventional systems that have two TEVs with bypassing check valves, as the additional TEV and the extra piping between the TEVs of the conventional reversible split system is eliminated. The TEV of the package system of the current application, by employing a bulbless thermostatic expansion valve, further eliminates the need to install the bulb used in conventional systems. Accordingly, fewer components are required for the overall system. In addition, by the use of a single bulbless TEV eliminating check valves for bypass, the configuration lowers cost and simplifies the system as compared to conventional configurations. The location of the TEV in the package system also increases the amount of liquid flowing through the heat exchangers, which improves distribution and may increase the capacity of the system. In addition, by sensing temperature and pressure immediately before the compressor, the TEV in the package system can be set to a lower superheat setting while protecting the compressor from liquid refrigerant. This will result in less heat that needs to be rejected and therefore results in higher system efficiency.

Figure 3:
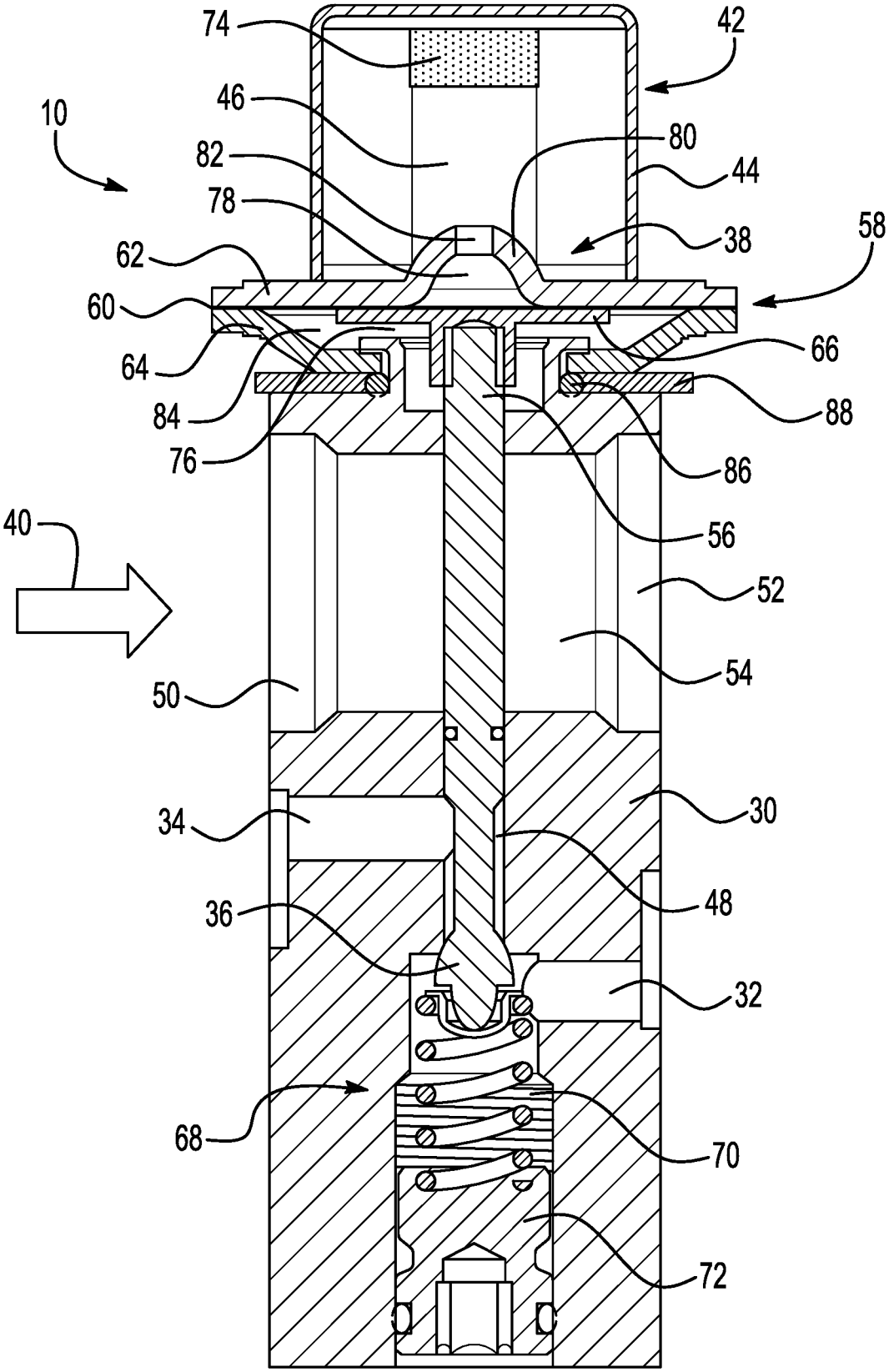
FIG. 3 is a drawing depicting a cross-sectional view of an exemplary configuration of a bulbless TEV according to an embodiment of the present application, that may be used in the split reversible heat pump/air conditioning system of FIG. 1.

FIG. 3 is a drawing depicting a cross-sectional view of an exemplary configuration of the bulbless TEV 12 according to an embodiment of the present application, that may be used in the split reversible heat pump/air conditioning system of FIG. 1. It will be appreciated that the structural configuration shown in FIG. 3 is presented as a non-limiting example, and the specific structure of the bulbless TEV 12 may vary within the broader configuration that the valve portion of the bulbless TEV 12 is placed on the common liquid line that runs between the indoor and outdoor heat exchangers, and the bulbless TEV sensor portion is placed on the suction line through which the refrigerant is suctioned into the compressor between the reversing valve and the compressor, thereby sensing temperature and pressure on the suction line.

The TEV 12 includes a valve body 30 having a first port 32 and a second port 34. The ports 32 and 34 are ports through the valve body along the common liquid line that runs between the indoor and outdoor heat exchangers. Accordingly, either the first port 32 or the second port 34 may function as the inlet versus the outlet of the valve body, depending upon whether the split reversible heat pump/air conditioning system is operating in the air conditioning mode versus the heat pump mode. The valve body 30 houses a valve member 36 that is coupled to a power element 38 for controlling operation of the valve member to thereby control flow of operating fluid through the valve body 30. The TEV further is coupled to a suction line 40 through which the refrigerant ultimately is suctioned into the compressor as referenced above. The TEV 12 includes a thermal sensor 42 operatively mounted to the power element 38, and the thermal sensor 42 includes a sensor enclosure 44 that at least partially forms a sensing chamber 46 that contains a sensing fluid. The valve member 36 is movable relative to the valve body 30 in response to actuation by the power element 38 to thereby control operating fluid flow through a flow path 48 between the first port 32 and the second port 34 that is part of the common liquid line between the indoor and outdoor heat exchangers.

As further shown in the cross-sectional view of FIG. 3, the valve body 30 includes a suction line inlet 50 and a suction line outlet 52, and a second fluid passage 54 for flow of operating fluid between from the suction line inlet to the suction line outlet. In the illustrated embodiment, the suction line inlet 50 is connected to the outlet of the reversing valve 28 (see FIG. 1) for receiving operating fluid, which passes through the passage 54 and out of the suction line outlet 52 for to be received by the compressor 26 (see also FIG. 1). As such, the valve body 30 is constructed such that the second passage 54 forms a segment of the suction line 40. As shown, the valve body 30 may be constructed to provide a relatively short path from the suction line 40, i.e., via passage 54, to the power element 38 to improve responsiveness and control of the TEV 12.

The valve member 36 may have any suitable valve structure, such as for example a poppet valve or pin that can seat against a valve seat for opening, closing, or modulating flow through the flow path 48. In the illustrated embodiment, the valve member 36 includes an elongated stem portion that extends through the valve body 30 across the flow path 54 to an opposite (e.g., upper) end portion 56 of the valve member 36. The end portion 56 of the valve member may include suitable abutments or stops, such as shoulder portions or the like.

The power element 38 includes a multipart housing 58 and a diaphragm 60 that is fixed in position by the multipart housing 58. The multipart housing 58 includes an upper housing 62 overlying the diaphragm 60, and a lower housing 64 underlying the diaphragm 60. The multipart housing 58 is configured to hold the diaphragm 60 in position, such as by sandwiching an outer peripheral portion of the diaphragm 60 between the upper housing 62 and the lower housing 64. The diaphragm 60 may be fixedly attached, such as by welding or otherwise adhering, portions of the diaphragm 60 to the multipart housing 58.

The diaphragm 60 is operatively coupled to the valve member 36, such as being directly or indirectly attached to a first side (e.g., underside) of the diaphragm 60. The diaphragm 60 may have any suitable structure and be made of any suitable material for enabling movement of the valve member 36 in response to force applied to the diaphragm 60. For example, the diaphragm 60 may be made of a thin sheet or sheets of material that are configured to flex or bow in response to a force applied to the diaphragm 60. The diaphragm 60 may be made of a suitable material, such as metal, which is impermeable to liquid or gas. To enhance the flexing of the diaphragm 60, the upper end 56 of the valve member 36 may include or be fitted with a pressure pad 66. An upper surface of the pressure pad 66 is a widened and flat surface that underlies the diaphragm 60 to distribute the forces imparted between the valve member 36 and the diaphragm 60.

The thermal sensor 42 of the TEV 12 is operatively mounted to, or integrated with, the multipart housing 58 of the power element 38, although the thermal sensor 42 also could be integrated with or operatively mounted to the valve body 30. In this manner, the sensor enclosure 44 may be supported by the valve body 30, or the valve body 30 may be supported by the sensor enclosure 44. In the illustrated embodiment of FIG. 3, for example, the sensor enclosure 44 is in the form of a dome mounted atop the power element 38 and which is directly attached to the upper housing 62 of the multipart housing 58 of the power element 38. The diaphragm 60 of the power element 38 serves as a partition that together with at least a portion of the sensor enclosure 44 forms and encloses the sensing chamber 46 to contain the sensing fluid. In exemplary embodiments, the sensor chamber 46 is formed as a closed thermodynamic system in which there is no mass flow into or out of the sensor chamber 46 during operation of the TEV. In this manner, the sensor enclosure 44 may be attached to the upper housing 62 of the power element 38 with a suitable connection, such as a gas impermeable weld. The TEV 12 is configured such that changes in temperature of the sensing fluid in the sensing chamber 46 results in contraction or expansion of the sensing fluid which changes the pressure in the sensing chamber 46, and therefore the force applied to the diaphragm 60 of the power element 38. The changes in pressure cause the diaphragm 60 to move (e.g., flex or bow), which in turn exerts force on the valve member 36 to further open or further close the TEV 12. As shown, the TEV 12 may further include an adjustment mechanism 68, such as a spring-biased adjuster including a spring 70 and threaded pin 72, whereby the spring force combines with fluid pressure at the underside of that diaphragm for counteracting the pressure from the sensing chamber 46 and thereby setting a desired control setpoint of the TEV 12.

The sensing fluid charged into the sensing chamber 46 may be any suitable fluid, such as a gas that can expand or contract in response to temperature changes. In exemplary embodiments, the sensing fluid is a refrigerant, which may be the same type or different type of refrigerant as the operating fluid. The sensing chamber 46 also may contain a ballast material 74, although in some applications a ballast material 74 is not required. The ballast material 74 may be any suitable ballast, such as a porous ceramic block or beads that adsorbs/desorbs the sensing fluid. The ballast material 74 can slow how fast the temperature and the related pressure in the sensing chamber 46 changes. This slows down the reactivity of the TEV 12 and stabilizes the output of the valve during operation. The amount and the type of ballast material 74 can be tailored to attain a specific superheat control desired.

In exemplary embodiments, the TEV 12 is configured such that heat energy transfers across the diaphragm 60 between the sensing fluid in the sensing chamber 46 that is in communication with the first (upper) side of the diaphragm and a region in communication with the second (under) side of the diaphragm 60. The region at the opposite second side of the diaphragm 60 may be in communication with the suction line of the system such that the temperature of the operating fluid communicates with the sensing fluid in the sensing chamber 46 across the diaphragm 60. In this manner, the region at the opposite (under) side of the diaphragm 60 may be an open thermodynamic system including mass and heat flow. In exemplary embodiments, a fluid flow passage 76 is provided to fluidly connect the suction line 40 to the region at the second (under) side of the diaphragm 60. The changes in temperature of the sensing fluid in the sensing chamber 46 resulting from the exchange of heat energy results in increasing or decreasing the pressure in the sensing chamber 46, and thus the force generated at the first (upper) side of the diaphragm 60. The region at the opposite (under) side of the diaphragm 60 (e.g., in fluid communication with the suction line 40) exerts an opposite force to the second (under) side of the diaphragm 60. The diaphragm 60 of the power element 38, and thereby the valve member 36, move in response to the pressure differentials on the opposite sides of the diaphragm 60.

In exemplary embodiments, the configuration of the multipart housing 58 of the power element 38 enables improved control of the TEV 12. For example, as shown in the illustrated embodiment, the multipart housing 58 is constructed to hold the radially outer peripheral portion of the diaphragm 60 to constrain movement of the diaphragm 60. The first (upper) housing 62 and/or the second (lower) housing 64 of the multipart housing 58 may extend radially inwardly to further constrain flexure of the diaphragm 60 as may be desired. As shown, a radially inward portion of the upper housing 62 may be closely arranged to the upper side of the diaphragm and may slightly taper upwardly toward center to permit a desired amount of flexure of the diaphragm 60. A radially inward portion of the lower housing 64 also may be constructed to permit a desired amount of flexure of the diaphragm 60. The upper side communicating with the sensing chamber 46 may be closer than the opposite side, as shown, to permit more downward flexure than upward flexure of the diaphragm 60.

To provide suitable fluid communication with the sensing chamber 46 and/or a desired amount of fluid pressure at the upper side of the diaphragm 60, the first (upper) housing 62 of the multipart housing 58 may be configured to provide a first (e.g., upper) chamber 78 formed by at least a portion of the first (upper) housing 62 of the multipart housing 58 together with at least a portion of the upper side of the diaphragm 60. In the illustrated embodiment, a dome-shaped protrusion 80 forms at least part of the upper chamber 78 and includes an orifice 82 for providing fluid communication with the sensing chamber 46.

To provide suitable fluid communication with the underside of the diaphragm 60, the second (lower) housing 64 of the multipart housing 58 may be configured to provide a second (e.g., lower) chamber 84 formed by at least a portion of the second (lower) housing 64 together with at least a portion of the underside of the diaphragm 60. In this manner, the diaphragm 60 serves as a divider that divides the internal chamber of the multipart housing 58 into the first (e.g., upper) chamber 78 and the second (e.g., lower) chamber 84, and is configured to permit transfer of heat energy but restrict transfer of fluid from the sensing chamber 46 and upper chamber 78 to the lower chamber 84. As shown, the lower housing 64 of the multipart housing 58 may provide a seat or stop for the upper portion 56 of the valve member 36 to control the valve member movement. A suitable seal 86, such as an O-ring seal, may be arranged between the valve body 30 and the power element 38 to provide a suitable seal.

As noted above, the region at the underside of the diaphragm 60 (e.g., the lower fluid chamber 84) may be fluidly connected to the suction line 40 of the system via the fluid flow passage 76 so that the TEV 12 is reactive to adjust the valve member 36 in response to temperature and pressure of the operating fluid flowing through the suction line. As shown, the passage 76 may be formed at least partially by a vertical bore that contains the upper portion 56 of the valve member 36. The passage 76 connected to the suction line 40 of the system also may be referred to as an internal equalization passage or equalization line. The fluid (e.g., refrigerant vapor) may flow through the passage 76 into the chamber 84 to be in direct contact with the diaphragm 60 and permit heat energy transfer across the diaphragm 60 with the sensing fluid in the sensing chamber 46 via upper chamber 78. The diaphragm 60 may be a heat conductive material, such as metal, to facilitate such heat transfer. The power element 38 is responsive to forces acting on opposite sides of the diaphragm 60 via pressure changes in each of the lower 84 and upper 78/46 chambers to thereby adjust position of the valve member 36 and control flow between inlet 32 and outlet 34.

In some cases, outside temperature influences on the sensing fluid in the sensing chamber 46, other than that transferred through the diaphragm 60, could affect the reactivity and control of the TEV 12. As such, in exemplary embodiments, it may be beneficial to thermally isolate the enclosure 44 of the sensing chamber 46 in one or more ways. For example, in exemplary embodiments, the sensor enclosure 44 is spaced apart from one or more, or all, operating lines of the system, such as the suction line 40 which may contain hot evaporated refrigerant. The sensor operates to measure the temperature of the suction line, and the body material is affected by the mix of ambient effects, liquid into the valve, suction fluid out of the valve, and suction vapor into the valve (upper chamber). Sensor spacing may be accomplished, for example, by arranging the sensor enclosure 44 to not intersect with a flow path of operating fluid flowing through the valve body, with the suction flow traveling to the diaphragm of the power element to get an accurate measurement of the temperature. In FIG. 3, for example, the sensor enclosure 44 is operatively mounted to the valve body 30 such that the multipart housing 58 of the power element 38 is arranged between the enclosure 44 and the valve body 30. The operating fluid flows through passages 48 and 54 and thus does not intersect with the enclosure 44, but instead provides heat transfer with the sensing chamber 46 via the flow passage 76 and diaphragm 60 in the manner described above. Such a configuration can reduce the reactivity of the TEV 12, which may be useful to prevent overshooting or hunting phenomena.

To further isolate the enclosure 44 and sensing chamber 46 from unwanted heat transfer, a thermal spacer 88 may be arranged between the lower housing 64 of the power element 38 and the suction line 40. The thermal spacer 88 may be made from any suitable material in any suitable form that reduces heat transfer (e.g., conduction) between the two members, and more specifically, may be designed to reduce reactivity of the TEV 12 by thermally insulating the sensing chamber 46. For example, the thermostatic spacer 88 may be in the form of a thermostatic insulator made from a suitable thermally insulative material having a low thermostatic conductivity (e.g., less than 50 W/mk; more particularly less than 10 W/mK; or less than 1.0 W/mK; or less than 0.50 W/mK, such as in a range from 0.01-50 w/mK, for example). Non-limiting examples of such thermally insulative materials may include, for example, polymers (e.g., nylon, PEEK, PTFE, silicone, etc.), glass (e.g., fiberglass), ceramics (e.g., alumina, silica, etc.), minerals (e.g., mineral wool), foams, or the like. Alternatively or additionally, the thermostatic spacer 88 may be formed as a structure with an increased thickness to reduce heat conduction. Such a thermostatic spacer with increased thickness may or may not be an insulative material, but instead may be a thermally conductive material (such as metal) having sufficient thickness to reduce heat transfer to the sensing chamber 46. In the illustrated embodiment in which the suction line is formed by part of the valve body 30, the thermostatic spacer 88 is formed as an insulative spacer that is arranged between the lower housing 64 of the power element 38 and the valve body 30. This positioning restricts heat transfer from the valve body 30 and improves the control of the TEV 12.

The bulbless configuration of the TEV 12 provides numerous advantages over conventional configurations that use a bulb. For example, valve body 30 incorporating the suction line 40, 54 facilitates assembly of the TEV into the system. The TEV 12 may also be lower cost because it contains fewer parts. The thermostatic coupling of the suction line to the sensor chamber 46 via the flow passage 76 allows for elimination of the bulb and capillary tube in conventional TEV installations and the problems associated therewith. For example, the elimination of the bulb eliminates issues associated with poor attachment of the bulb on the suction line, which is typically accomplished with a metallic clamp often resulting in discontinuous contact with the suction line and results in the valve failing to control superheat as intended. The TEV 12 with the thermostatic sensor 42 as described provides more predictable thermostatic communication than prior bulb designs. The elimination of the capillary tube also eliminates issues with capillary tube breakage or charge migration in the capillary tube (condensation in the capillary tube). In addition, the equalizer line (passage 76) is used to sense pressure of the suction line 40, and by providing a relatively short path between the suction line and power element 38, issues such as clogging and unwanted cooling, may be minimized.

Figure 4:
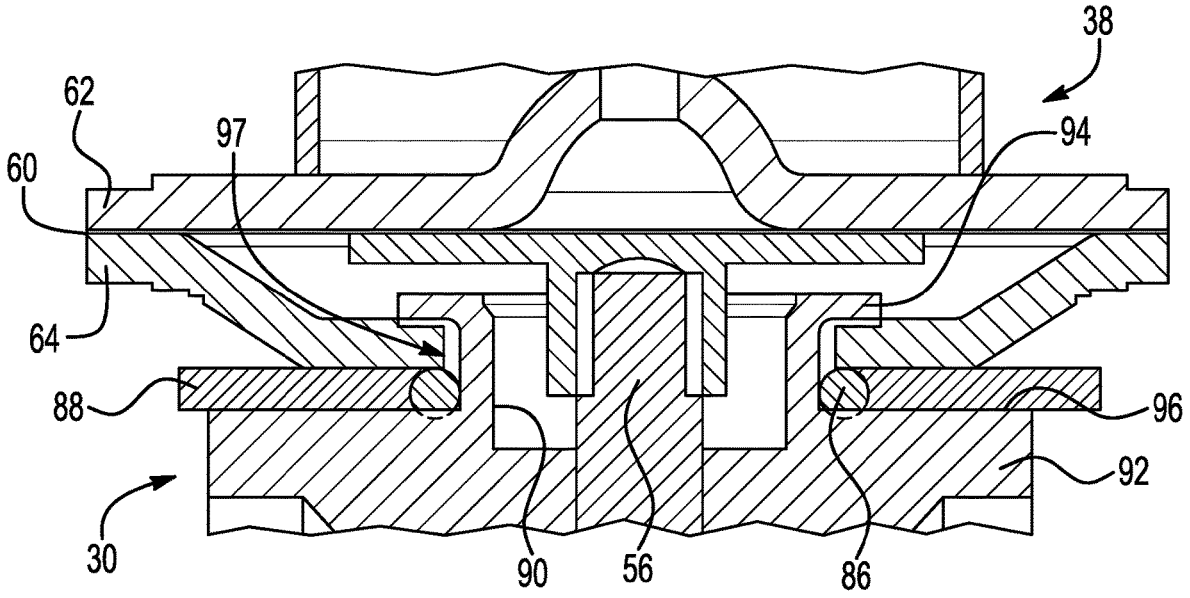
FIG. 4 is a drawing depicting a close-up view of a portion of the TEV of FIG. 3 to illustrate an example manner of joining of the power element to the valve body.

FIG. 4 is a drawing depicting a close-up view of a portion of the TEV 12 to illustrate an example manner of joining of the power element 38 to the valve body 30. Certain reference numerals of FIG. 3 are not indicated in FIG. 4 to provide a clearer illustration of the joining elements. Some traditional methods of joining the power element to the valve body in a TEV are complex and time consuming, and may require additional sealing elements. In view of the deficiencies of conventional TEVs, the configuration of TEV 12 provides enhanced joining of the power element 38 to the TEV valve body 30 as compared to conventional configurations. Referring to the close-up view of FIG. 4, the valve body 30 includes an upper extension 90 that extends from a main body portion 92 of the valve body 30. As seen in the depiction of FIG. 4, the upper extension 90 may be positioned concentrically and radially outward relative to the upper portion 56 of the valve member 36. The upper extension 90 further may be centrally located relative a longitudinal axis of the main body portion 92.

The enhanced joining of the power element 38 to the valve body 30 is provided by deforming or crimping an end of the upper extension 90 of the valve body 30 to form a lip 94 relative to an opposing upper surface 96 of the main body portion 92 of the valve body. The lip 94 and the opposing upper surface 96 of the main body portion 92 of the valve body thus define a recess 97 that receives a portion of the housing of the power element 38, such as an end portion of the lower housing 64 of the multipart housing 58 of the power element 38. The power element may be joined to the valve body by placing the lower housing 64 of the power element on the upper surface 96 and around the upper extension 90 of the valve body 30. Once the lower housing of the power element is so positioned, the end of the upper extension 90 of the valve body is deformed or crimped to form the lip 94, such that the lip 94 and opposing upper surface 96 define the recess in which the end portion of the lower housing 64 is now situated. The crimping operation results in a tight and robust interaction of the lip against the lower housing of the power element, and in this manner, the lower housing becomes robustly and tightly secured within the recess by the crimping operation. The end of the upper extension 90 of the valve body may be roll formed to form the lip 94, i.e., the end of the upper extension of the valve body may be deformed or crimped using a roll forming process to form the lip.

In an exemplary embodiment that includes the thermal spacer 88 and the O-ring 86, the thermal spacer and the O-ring first are positioned on the upper surface 96 and around the upper extension 90 of the valve body, with the O-ring being positioned radially inward relative to the thermal spacer. The thermostatic spacer 88 may be retained in place using any suitable fastening element, and one or more dowel pins provides a suitable example manner for retaining the thermostatic spacer in place, which in turn operates to secure retention of the O-ring 86. The lower housing 64 of the power element is then placed on the thermal spacer 88 and O-ring 86 and also around the upper extension 90 of the valve body. Once the lower housing of the power element is so positioned on the thermal spacer and O-ring, the end of the upper extension of the valve body is deformed or crimped as referenced above, such as by roll forming, to form the lip 94 defining the recess with the opposing upper surface 96, and then the lower housing becomes secured by the crimping (roll forming) operation within the recess against and along with the thermal spacer and O-ring.

Figure 5:
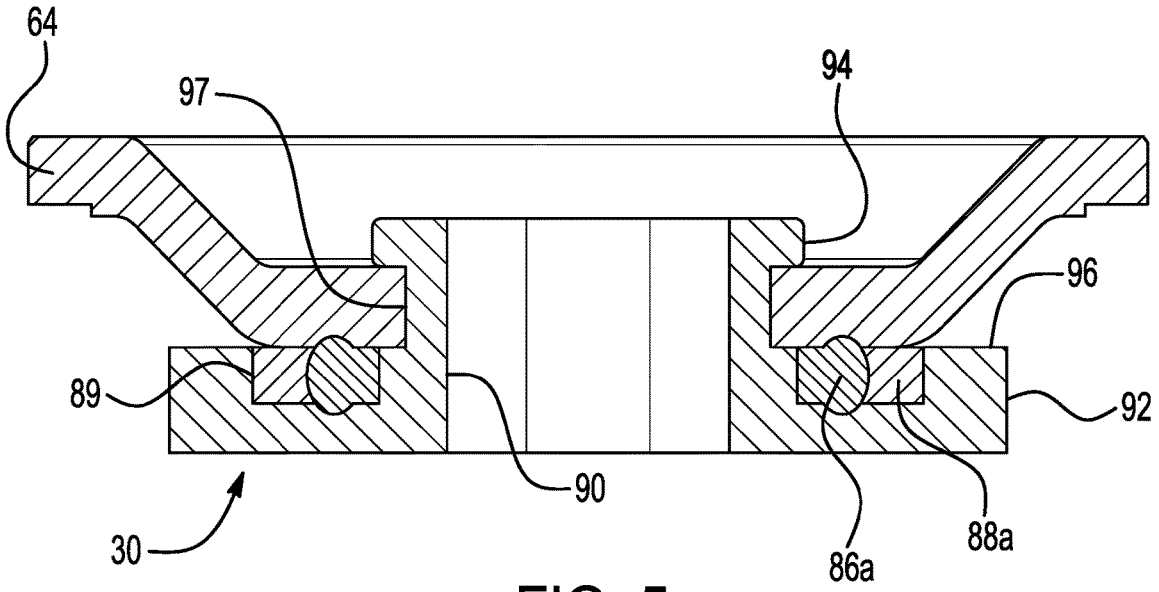
FIG. 5 is a drawing depicting a portion of the close-up view of the TEV portion of FIG. 4 to illustrate an alternative configuration of incorporating the thermostatic spacer and O-ring into the valve body.

FIG. 5 is a drawing depicting a portion of the close-up view of the TEV portion of FIG. 4 to illustrate an alternative configuration of incorporating the thermostatic spacer and O-ring into the valve body. Certain components are omitted from the depiction of FIG. 4 for clarity of illustration. In the example of FIG. 5, the upper surface 96 of the main body portion 92 of the valve body has a recess 89 that receives an O-ring 86*a* and a thermostatic spacer 88*a*. For applications involving relatively higher pressures, the recess 89 holds the thermostatic spacer 88*a* in place for enhanced support and retention of the O-ring 86*a*, as compared to, for example, dowel pins as may be used in the previous embodiment. The TEV otherwise may be configured comparably as in the previous embodiment.

In general, the O-ring 86 (86*a*) and the thermostatic spacer 88 (88*a*) may be configured as separate components as illustrated in the figures. The O-ring 86 (86*a*) and the thermostatic spacer 88 (88*a*) may be made of the same or different materials, and/or may have the same or a varying hardness, as may be suitable to provide optimized compressibility and thermal properties for a given application. In another variation, the O-ring 86 (86*a*) and the thermostatic spacer 88 (88*a*) may be a single, integral component. As an integrated component, the combination O-ring thermostatic spacer may be configured as a uniform material, or the combination O-ring thermostatic spacer may be configured as co-molded or otherwise co-formed different materials, which again may have the same or a varying hardness as may be suitable to provide optimized compressibility and thermal properties for a given application.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A split reversible heat pump/air conditioning system comprising:

a compressor that supplies a refrigerant flow along a refrigerant pathway;

an indoor heat exchanger;

an outdoor heat exchanger;

a reversing valve located along the refrigerant pathway between the outdoor heat exchanger and the compressor, and between the indoor heat exchanger and the compressor; and a thermostatic expansion valve comprising a valve portion located along a common liquid line of the refrigerant pathway between the indoor heat exchanger and the outdoor heat exchanger that throttles the refrigerant flow as between the indoor heat exchanger and the outdoor heat exchanger, and a sensor portion for sensing pressure and temperature located along a suction line of the refrigerant pathway between the compressor and the reversing valve;

wherein the sensor portion of the thermostatic expansion valve is a bulbless pressure and temperature sensor; and wherein the thermostatic expansion valve comprises:

a valve body having a first port and a second port;

a valve member movable relative to the valve body for controlling flow of an operating fluid through the valve body between the first port and the second port;

a power element including a housing and a diaphragm positioned within the housing, the diaphragm having a first side operatively coupled to the valve member and a second side opposite the first side; and a thermal sensor including a sensor enclosure operatively mounted to the power element, wherein a portion of the sensor enclosure together with a portion of the second side of the diaphragm form a sensing chamber in which a sensing fluid is contained;

wherein changes in the temperature of the sensing fluid results in changes in pressure applied to the second side of the diaphragm, thereby causing movement of the diaphragm which provides movement of the valve member operatively coupled to the first side of the diaphragm.

2. The split reversible heat pump/air conditioning system of claim 1, wherein the sensor portion includes a diaphragm, and the diaphragm is positioned with the suction line running below the diaphragm and a refrigerant charge maintained above the diaphragm.

3. The split reversible heat pump/air conditioning system of claim 1, wherein during an air conditioning mode the valve portion of the thermostatic expansion valve throttles the refrigerant flow into the indoor heat exchanger based on a temperature and pressure sensed by the sensor portion on the suction line, and during a heat pump mode the refrigerant flow is reversed by the reversing valve relative to the air conditioning mode and the valve portion of the thermostatic expansion valve throttles refrigerant flow into the outdoor heat exchanger based on the temperature and pressure sensed by the sensor portion on the suction line.

4. The split reversible heat pump/air conditioning system of claim 1, wherein the outdoor heat exchanger, the reversing valve, the compressor, and the thermostatic expansion valve are packaged in a common outdoor unit of the split reversible heat pump/air conditioning system.

5. The split reversible heat pump/air conditioning system of claim 1, wherein the first port and the second port are part of the common liquid line between the indoor heat exchanger and the outdoor heat exchanger.

6. The split reversible heat pump/air conditioning system of claim 1, wherein the thermostatic expansion valve further includes a suction line inlet and a suction line outlet that are part of the suction line between the reversing valve and the compressor.

7. The split reversible heat pump/air conditioning system of claim 1, wherein the sensor enclosure of the thermostatic expansion valve is adapted to be operatively mounted to the suction line.

8. The split reversible heat pump/air conditioning system of claim 7, wherein a region at the first side of the diaphragm is configured to be in communication with an operating fluid of the system, such that heat is transferable across the diaphragm between the sensing chamber and the region at the first side, whereby changes in the temperature of the sensing fluid results in changes in pressure applied to the second side of the diaphragm, and pressure from the operating fluid is applied to the first side, and wherein the diaphragm and thereby the valve member are configured to move in response to the pressure differential on the first and second sides of the diaphragm.

9. The split reversible heat pump/air conditioning system of claim 1, wherein the valve body of the thermostatic expansion valve includes an upper extension that extends from a main body portion, an end of the upper extension being crimped into a lip relative to an opposing surface of the main body portion thereby defining a recess that receives a portion of the housing of the power element to join the power element to the valve body.

10. The split reversible heat pump/air conditioning system of claim 9, wherein the housing of the power element is a multipart housing including an upper housing and a lower housing, with the diaphragm being secured between the upper housing and the lower housing; and an end of the lower housing is the portion of the housing of the power element that is received within the recess.

11. The split reversible heat pump/air conditioning system of claim 9, wherein the thermostatic expansion valve further includes a thermal spacer positioned on the upper surface of the main body portion of the valve body and around the upper extension of the valve body, and the lower housing of the power element is positioned on the thermal spacer opposite from the upper surface of the main body portion of the valve body.

12. The split reversible heat pump/air conditioning system of claim 11, wherein the thermostatic expansion valve further includes an O-ring positioned on the upper surface of the main body portion of the valve body and around the upper extension of the valve body, the O-ring being positioned radially inward relative to the thermal spacer.

13. The split reversible heat pump/air conditioning system of claim 1, wherein the wherein the thermostatic expansion valve is devoid of a sensing bulb and external capillary tube, and the sensing fluid is contained entirely in the sensor enclosure as a self-contained closed thermodynamic system.

* * * * *